United States Patent [19]

Corbett

[11] Patent Number: 4,597,263

[45] Date of Patent: Jul. 1, 1986

[54] PULL TYPE INSTALLATION TOOL

[75] Inventor: Robert J. Corbett, Saugerties, N.Y.

[73] Assignee: Huck Manufacturing Company, Irvine, Calif.

[21] Appl. No.: 320,193

[22] Filed: Nov. 12, 1981

Related U.S. Application Data

[63] Continuation of Ser. No. 85,867, Oct. 18, 1979, abandoned.

[51] Int. Cl.[4] ..... B60T 17/22

[52] U.S. Cl. ..... 60/534; 60/572; 60/586; 60/592; 60/593

[58] Field of Search ..... 60/534, 586, 587, 592, 60/583, 593, 571, 572; 72/391

[56] References Cited

U.S. PATENT DOCUMENTS

| | | | |
|---|---|---|---|
| 2,092,251 | 9/1937 | Heidloff . | |
| 2,179,201 | 11/1939 | Scott . | |
| 2,526,956 | 10/1950 | Kugler . | |
| 2,540,879 | 2/1951 | Hebel | 60/572 |
| 2,789,539 | 4/1957 | Griffith et al. . | |
| 2,820,566 | 1/1958 | Van Hecke . | |
| 3,088,618 | 5/1963 | Pickford . | |
| 3,105,416 | 10/1963 | Van Hecke . | |
| 3,137,369 | 6/1964 | Stromberg . | |
| 3,247,668 | 4/1966 | Van Hecke et al. . | |
| 3,250,247 | 5/1966 | Beaman . | |
| 3,254,522 | 6/1966 | Elliott et al. . | |
| 3,255,675 | 6/1966 | Reeve et al. . | |
| 3,309,911 | 3/1967 | Simmons . | |
| 3,367,166 | 2/1968 | Newton et al. . | |
| 3,374,656 | 3/1968 | Di Maio . | |
| 3,410,128 | 11/1968 | Sauter et al. . | |
| 4,027,520 | 6/1977 | Klein . | |
| 4,052,855 | 10/1977 | Prillinger et al. . | |
| 4,059,981 | 11/1977 | Holloway . | |
| 4,062,217 | 12/1977 | Ebbert et al. . | |
| 4,118,969 | 10/1978 | Corbett . | |
| 4,133,287 | 1/1979 | Downs . | |
| 4,166,431 | 9/1979 | Pickering . | |
| 4,372,118 | 2/1983 | Andresen | 60/586 |

FOREIGN PATENT DOCUMENTS

| | | |
|---|---|---|
| 995499 | 6/1965 | United Kingdom . |
| 2040775 | 1/1979 | United Kingdom . |
| 1569569 | 6/1980 | United Kingdom . |

*Primary Examiner*—Abraham Hershkovitz

*Attorney, Agent, or Firm*—Harness, Dickey & Pierce

[57] ABSTRACT

An improved pneumatic-hydraulic actuated single action pull type installation tool for installing pull type fasteners is disclosed which includes a continuously pressurized fluid reservoir operative to maintain a minimum positive pressure on the hydraulic circuit during operation so as to protect the integrity of the hydraulic circuit during normal operating pressure fluctuations and to reduce the possibility of air being drawn into the hydraulic system during sudden pressure drops in the actuating pressure chamber which may occur at the time the pintail portion is separated from the fastener. Further, the reservoir provides a source of make up hydraulic fluid to replace any fluid which may be lost due to leakage. Suitable valves are provided to enable the reservoir to selectively communicate with both driving and return portions of the hydraulic circuit while still enabling selective pressurization thereof. Apparatus is also provided for enabling convenient and efficient refilling of the reservoir and to depressurize the reservoir such as for service. A high pressure relief valve is also provided in the circuit which is operative to vent the hydraulic system to atmosphere in the event of abnormal pressure build up.

13 Claims, 6 Drawing Figures

PULL TYPE INSTALLATION TOOL

This is a continuation of application Ser. No. 85,867, filed Oct. 18, 1979, now abandoned.

BACKGROUND AND SUMMARY OF THE INVENTION

The present invention relates generally to pneumatic-hydraulically operated tools and more particularly to such tools which are designed for use in installation of pull type fasteners.

In pneumatic-hydraulic installation tools of the same type as the present invention, a source of compressed air is normally selectively applied to opposite sides of a pneumatic piston by an operator controlled valve assembly so as to reciprocably drive the piston through driving and return strokes. This pneumatic piston is in turn connected to a master hydraulic piston reciprocably disposed within a cylinder forming a part of a closed hydraulic circuit and operates to reciprocate the hydraulic piston in unison therewith. The hydraulic piston in turn operates to transmit hydraulic pressure and fluid to a slave or driving piston reciprocably in a separate cylinder also forming a part of the closed hydraulic circuit which piston has apparatus associated therewith for setting a fastener. The hydraulic pulling and master pistons may be viewed as separating the hydraulic circuit into a driving portion and a return portion which are alternatingly pressurized in response to reciprocal actuation of the pneumatic piston. Accordingly, during operation of the installation tool the various hydraulic seals required therein are continuously subjected to an extreme pressure range extending from a low pressure which may be below atmospheric pressure to a high pressure well in excess of atmospheric pressure. This continual cycling of pressure on the seals and particularly the change between positive and negative pressure relative to atmospheric pressure has been found to be detrimental to seal efficiency and may result in premature failure or leakage thereof both in terms of loss hydraulic fluid and entry of air into the hydraulic circuit. Entry of air into a hydraulic circuit is extremely detrimental to operating efficiency of the circuit because of the relative volumetric changes which result from pressure changes applied thereto. Accordingly, the presence of air in a hydraulic system results in lost motion within the system.

Additionally, in some such tools, a seal failure on either the hydraulic master or pulling pistons may result in generation of a relatively high internal pressure which may cause damage to the tool or result in failure of additional seals necessitating repairs more extensive than might otherwise be required.

The present invention, however, provides a hydraulic reservoir which includes apparatus to maintain a continuous positive pressure on the hydraulic circuit during operation of the tool whereby the detrimental effect of cyclical positive and negative pressures on the seals may be avoided. The reservoir system is designed so as to establish a minimum positive pressure of a magnitude relatively low as compared to the operating pressures of the tool and also operates to provide a supply of make up hydraulic fluid to compensate to a limited extent for leakage during operation of the tool. Apparatus is also provided whereby the reservoir may be easily and conveniently depressurized such as may be desired during service of the tool. Additional apparatus is disclosed which enables the reservoir to be easily and conveniently refilled.

While the reservoir is directly connected to the return portion of the hydraulic circuit, means are also incorporated therein whereby the driving portion of the hydraulic circuit may be similarly subjected to a minimum positive pressure during operation of the tool.

The hydraulic circuit of the present invention also incorporates pressure relief means which will operate to relieve internal pressures which may be generated due to a piston seal failure on either the hydraulic master or pulling pistons thereby minimizing the possibility of resultant damage to the tool.

Additional advantages and features of the present invention will become apparent from the subsequent description and the appended claims taken in conjunction with the accompanying drawings.

DESCRIPTION OF THE PREFERRED EMBODIMENT

Figures 1, 2, 3, 4, 5:
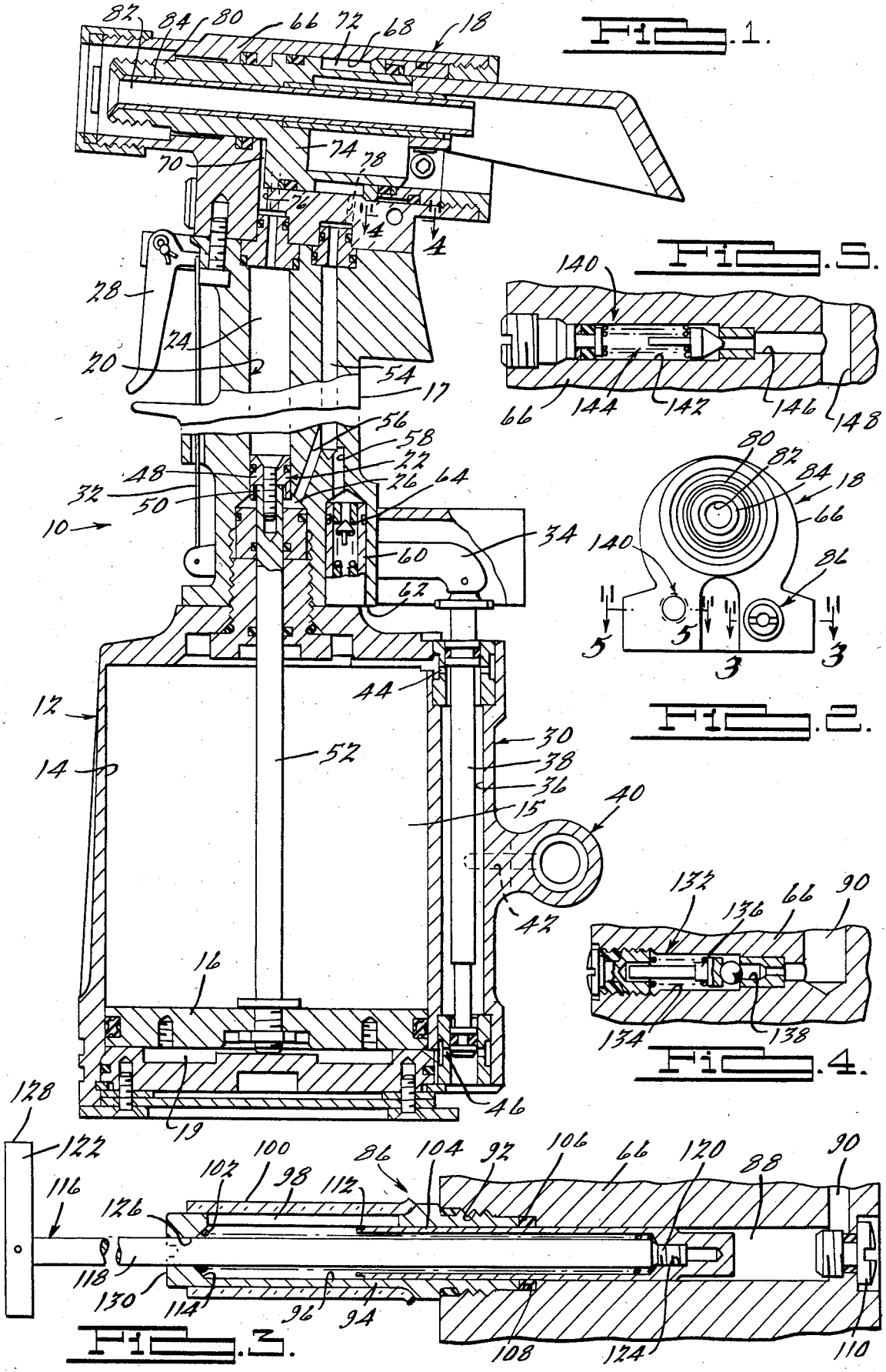
FIG. 1 is a sectioned side elevational view of a pull type installation tool in accordance with the present invention.
FIG. 2 is a frontal view of a portion of the installation tool of FIG. 1 showing the head assembly only.
FIG. 3 is a fragmentary section view of a portion of the installation tool of FIG. 1 showing the reservoir assembly and fill tool, the section being taken along line 3—3 of FIG. 2.
FIG. 4 is a fragmentary sectioned view of a portion of the installation tool of FIG. 1 showing the check value, the section being taken along line 4—4 thereof.
FIG. 5 is a fragmentary sectioned view of a portion of the installation tool of FIG. 1 showing the return pressure relief valve, the section being taken along line 5—5 of FIG. 2.

Referring now to the drawings and in particular to FIG. 1, there is shown a fluid actuated pull gun in accordance with the present invention indicated generally at 10 which is of the single action type and which is particularly adapted for use in setting conventional pull type fasteners which include a separable pintail portion engageable by a jaw assembly attached to the pulling tool although it will be understood that the present invention is applicable to other uses.

Pull gun 10 includes a housing 22 which defines a cylinder 14 in which a pneumatic piston 16 is movably disposed which divides cylinder 14 into upper and lower portions 15 and 19 respectively. As shown, piston 16 includes a suitable seal to prevent fluid communication between upper and lower portions 15 and 19. A neck assembly 17 has one end secured to housing 12 and a hydraulically actuated driving head assembly 18 secured to the other end remote from cylinder 14. Neck assembly 17 serves as a hand grip and also carries an elongated cylinder 20 having a hydraulic piston assembly 22 reciprocably mounted therein and dividing cylinder 20 into upper and lower portions 24 and 26. Cylinder 20 is filled with hydraulic fluid and piston assembly 22 operates to transmit fluid pressure imposed on piston assembly 16 to the driving head assembly 18.

A trigger 28 is pivotably connected to neck assembly 17 at a position adjacent head assembly 18 and is operatively connected to a control value assembly 30 provided on housing 12 through an elongated rod 32 and associated pivotable level arm 34. Control valve assembly 30 includes an elongated chamber 36 within which a valve member 38 is movably disposed. Connection means 40 are provided to which a compressed air supply line may be connected to provide a supply of compressed air to chamber 36 via an inlet passage 42. A pair of ports 44 and 46 extend generally radially outwardly adjacent opposite ends of chamber 36 which are selectively operable to place chamber 36 in fluid communication with upper and lower portions 15 and 19 respectively of cylinder 14 and one or the other sides of piston 16. Suitable seals are provided on valve member 38 adjacent opposite ends thereof so as to prevent escape of compressed air from chamber 36. When valve member 38 is in the position shown, port 44 will admit compressed air from chamber 36 into upper portion 15 of cylinder 14 while venting lower portion 19 of cylinder 14 to atmosphere via port 46.

Hydraulic piston assembly 22 includes a master hydraulic piston 48 movably disposed within cylinder 20 and connected to one end 50 of a rod 52 the other end of which is secured to pneumatic piston 16 so as to enable piston 16 to drive piston 48. Piston 48 is also provided with a suitable seal to prevent fluid communication between upper and lower portions 24 and 26. Thus, when trigger 28 is depressed, air under pressure will flow from chamber 36 through port 46 into lower portion 19 of cylinder 14 thereby causing piston 16 to move in an upward direction as shown in FIG. 1 thereby driving hydraulic piston 48 upwardly so as to displace hydraulic fluid from portion 24 of cylinder 20.

Neck assembly 17 also has an elongated fluid passage 54 extending generally parallel to cylinder 20 and terminating at its lower end at a generally diagonally extending passage 56 which opens into lower portion 26 of cylinder 20 at the lower end thereof. A second passage 58 extends downwardly and opens into an enlarged diameter bore 60 opening inwardly into neck assembly 17 from the base 62 thereof. The lower or outer end of bore 60 is open to atmosphere and a pressure relief valve 64 is secured therein so as to seal passage 58 during normal operation of the pull gun and will open only under abnormal conditions to relieve high internal pressures within the hydraulic system.

Head assembly 18 includes a housing 66 defining a cylinder 68 therein which is divided into forward and rearward portions 70 and 72 by a pulling piston 74 movably disposed therein. A pair of fluid passages 76 and 78 are provided in housing 66 of head assembly 18 which are operative to place upper portion 24 of cylinder 20 and passage 54 in fluid communication with forward and rearward portions 70 and 72 of cylinder 68 respectively. Piston 74 includes an integral forwardly projecting portion 80 which is adapted to have a jaw assembly portion of a nose assembly (not shown) secured thereto, which nose assembly will also include a swaging anvil adapted to be secured to the forwardly projecting portion of the housing 66. A bore 82 extends through piston 74 and has a pintail guide tube 84 secured therein through which severed pintails are directed during operation of the gun.

As best seen with reference to FIGS. 2 and 3, pull gun 10 includes a continuously pressurized fluid reservoir assembly 86 disposed partially within housing 66 of head assembly 18. Reservoir assembly 86 comprises an elongated reservoir chamber 88 having an outlet passage 90 both of which are formed within housing 66. Reservoir chamber 88 has an enlarged diameter threaded portion 92 at the outer end thereof into which an elongated generally cylindrically shaped reservoir housing member 94 is fitted. Housing 94 is preferably cylindrical in shape and has a bore 96 of a cross sectional shape and size substantially identical to that of chamber 88. Housing 94 also has an axially extending cutout portion 98 extending along a portion of one side thereof opening into bore 96 and a transparent sleeve member 100 secured to housing 94 so as to close off cutout portion 98 while still providing a view of the interior of bore 96 thereby providing a sight gauge for the reservoir. While only one such sight gauge is illustrated, additional sight gauges may be provided in housing 94 if desired so as to insure an unobstructed view of the interior of bore 96. A helical coil spring 102 is disposed within bore 96 and is operative to bias an elongated movable plunger 104 into chamber 88 so as to continuously maintain chamber 88 under pressure. A seal 106 is disposed in an annular groove 108 adjacent the inner end of housing 94 which will effectively create a sealing engagement with plunger 104 so as to prevent fluid leakage from chamber 88. Preferably, plunger 104 will have a length sufficient to insure that seal 106 will engage the outer sidewall thereof at both the maximum inward and maximum outward movement thereof (to the left and right respectively as shown in FIG. 3). The sight gauge provided on reservoir housing 94 will afford a view of the outer end 112 of plunger 104 thereby providing a visible indication of the quantity of hydraulic fluid remaining in the reservoir chamber 88.

A removable plug member 110 threadedly engages the inner end of chamber 88 adjacent passage 90 and operates to provide access to chamber 88 for refilling of the reservoir. Outward movement of plunger 104 is limited by engagement of end portion 112 with spring seat 114 formed in housing 94.

A refilling tool 116 is also provided for retracting plunger 104. Refilling tool 116 comprises an elongated rod 118 having a threaded end portion 120 and a handle 122 pivotably secured to the opposite end thereof. A reduced diameter threaded opening 124 is provided within plunger 104 which is designed to receive threaded end portion 120 of refilling tool 116 which, as shown, may be inserted into engagement therewith through an opening 126 provided in the outer end and through surface 130 of housing 94.

In order to refill reservoir chamber 88, end portion 120 of tool 116 is inserted through opening 126 into engagement with threaded opening 124. Thereafter plug 110 is removed and plunger 104 drawn rearwardly outwardly relative to chamber 88 and to the left as shown by refilling tool 116. Once the terminal end 112 of plunger 104 has been drawn into engagement with spring seat 114, handle 122 of refilling tool 116 is pivoted approximately 90° so as to bring end portion 128 into opposed relationship with surface 130 of housing 94 and thereafter end portion 128 is allowed to move into engagement with surface 130 thus acting to retain plunger 104 in a withdrawn position. After the reservoir chamber 88 has been refilled and plug 110 replaced, refilling tool 116 may be removed allowing plunger 104 to be biased to the right thereby again pressurizing the reservoir chamber 88.

In an installation tool in accordance with the present invention having a driving stroke of approximately 0.6 inches and a maximum pulling capability of approximately 7,500 pounds, a reservoir was provided having a capacity of about ⅓ ounce of hydraulic fluid and a biasing spring was selected of a size to exert approximately 200 pounds positive pressure.

In order to isolate reservoir chamber 88 and to prevent full operating pressures from being exerted thereon which may effect continuing reciprocable movement of plunger 104, a check valve assembly 132 as shown in FIG. 4 is provided in head assembly 18. Check valve assembly 132 includes an elongated chamber 134 in which is disposed a conventional spring biased ball check valve 136 closing off an inlet passage 138 which is connected to fluid passage 90 extending from fluid reservoir 88. An outlet fluid passage (not shown) is also provided extending from chamber 134 of check valve assembly 132 to the rearward portion 72 of cylinder 68 so as to enable hydraulic fluid to be supplied thereto as well as to enable reservoir assembly 86 to maintain a continuous pressurized condition therein.

A return pressure relief valve assembly 140 is also provided within housing 66 of head assembly 18 which includes a chamber 142 within which is secured a suitable pressure responsive relief valve 144 operative to close off an inlet passage 146 communicating with a return fluid pressure passage 148 extending from rearward portion 72 of chamber 68 to passage 54 in neck assembly 17. An outlet passage (not shown) is provided in the sidewall of chamber 142 which is in fluid communication with forward portion 70 of cylinder 68 and the upper portion 24 of cylinder 20.

The operation of pull gun 10 and associated reservoir and return pressure relief valve may be best understood and will be explained with reference to the schematic diagram of FIG. 6 in which portions corresponding to like portions in tool 10 have been indicated by corresponding numbers.

As shown therein, when valve member 38 is moved to the right, pressurized air will be allowed to flow from chamber 36 through passage 46 into the right end portion 19 of cylinder 14 thereby forcing piston 16 to the left. As piston 16 moves to the left as shown, air within portion 15 of cylinder 14 will be vented to atmosphere via passage 44 and control valve assembly 30. Piston 16 will operate to drive hydraulic piston 48 via rod 52 to the left as shown thereby forcing hydraulic fluid from portion 24 of cylinder 20 into portion 70 of cylinder 68 thereby driving pulling piston 74 rearwardly with respect to head assembly 18 and through a fastener setting stroke. Hydraulic fluid within upper portion 72 of cylinder 68 will also be drawn or forced outwardly through passages 78 and 148 and into portion 26 of cylinder 24 by the movement of pistons 74 and 48. The relative decrease in volume of the portion 24 of cylinder 20 will be substantially equal to the relative increase in volume of portion 70 of cylinder 68. Similarly, the relative increase in volume of portion 26 of cylinder 20 will substantially equal the decrease in volume of portion 72 in cylinder 68. Upon completion of the fastener setting stroke, trigger 28 of FIG. 1 will be released thereby allowing valve member 38 to return to its normal position as shown in FIG. 6 whereupon pressurized air will be supplied to portion 15 of pneumatic cylinder 14 and portion 19 will be vented to atmosphere via passage 46. The relative pressure differential across pneumatic piston 16 will operate to force it to the right as shown resulting in piston 48 also being moved to the right forcing hydraulic fluid out of portion 26 of cylinder 20 and into portion 72 of cylinder 68. Thus piston 74 will be moved through a return stroke and forwardly with respect to head assembly 18 of FIG. 1 and hydraulic fluid from portion 70 will flow into portion 24 of cylinder 20. The hydraulic circuit disclosed may be considered comprising a pulling or driving portion which includes portions 24 of cylinder 20, passage 76 and the forward portion 70 of cylinder 68 and a return portion which includes portion 26 of cylinder 20, passages 148, 78, and portion 72 of cylinder 68. Thus, the hydraulic seals provided on respective pulling and master pistons 74 and 48 respectively define the dividing lines between the driving and return portions of the hydraulic circuit.

As shown reservoir assembly 86 is connected in fluid communication with return passage 148 through check valve 132 and will operate to insure that a continuous positive minimum pressure is exerted throughout the return portion of the hydraulic circuit due to the continuous biasing action of spring 102; this acts to minimize the possibility of any of the hydraulic seals associated with the return portion of the hydraulic circuit being subjected to a negative or less than atmospheric pressure which may allow entry of air into the otherwise closed hydraulic system. Thus, the actual magnitude of the minimum positive pressure to which the return portion of the circuit is subjected will of course be substantially equal to the pressure in the reservoir due to the biasing action of spring 102 on plunger 104 less the pressure necessary to open check valve 132.

Figure 6:
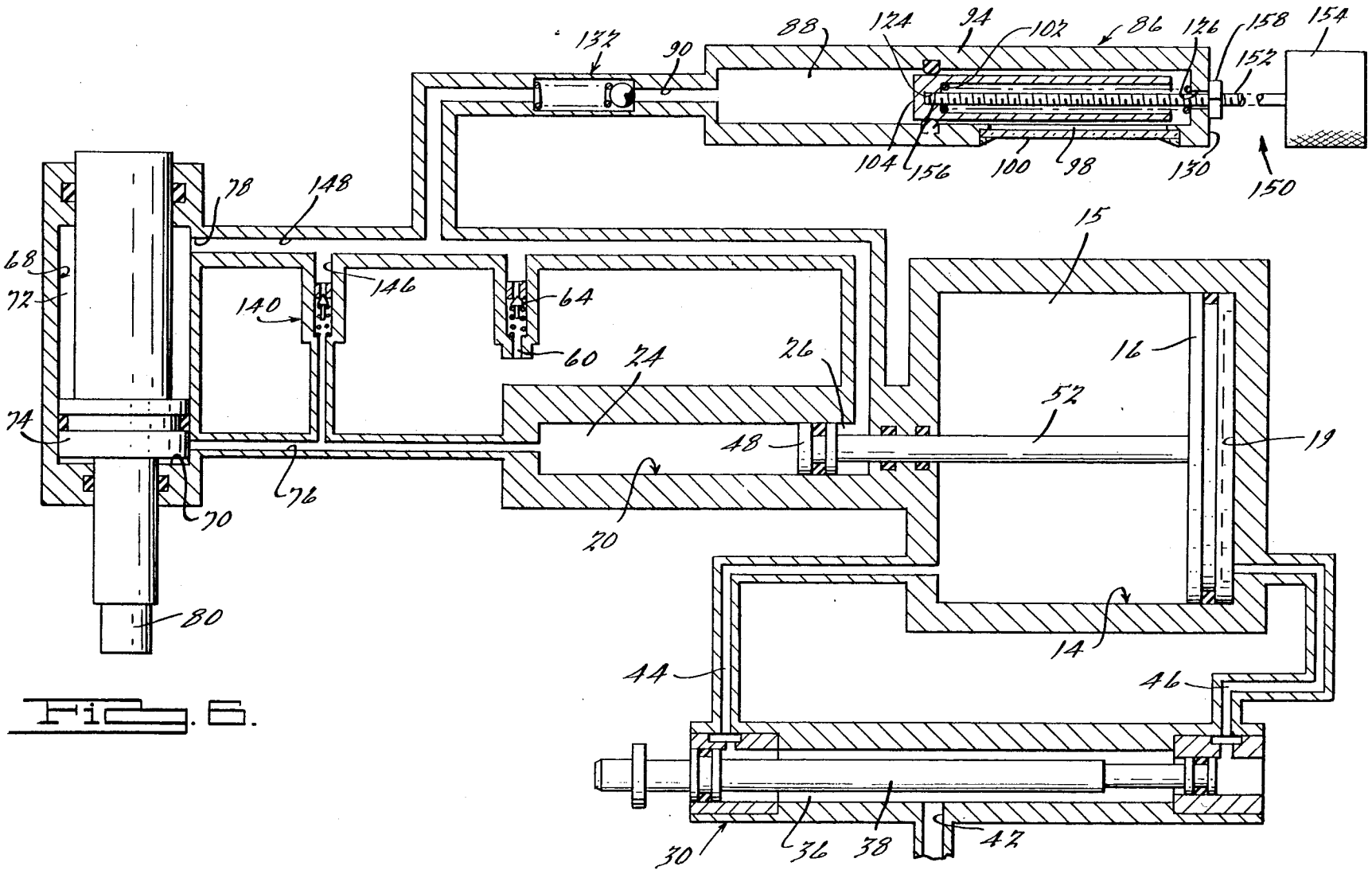
FIG. 6 is a schematic diagram of the pneumatic-hydraulic actuating circuit incorporated in the installation tool of FIG. 1 all in accordance with the present invention.

As also seen with reference to FIG. 6, return pressure relief valve 140 is interconnected between the driving and return portions of the hydraulic circuit. This pressure relief valve will be selected with a suitable pressure valve so as to enable it to open only when the pressure on the return portion of the hydraulic circuit is predetermind magnitude greater (in one preferred form on the order of 10% greater) than the maximum operating pressure differential necessary to return piston to its forwardmost position. The maximum volume of portion 26 of cylinder 20 may be controlled by sizing of rod 52 and preferably will be slightly greater than the maximum volume of portion 72 of cylinder 68. Thus, a relatively high pressure will be exerted on the return portion of the circuit at the end of the return stroke which will operate to open pressure relief valve 140 so as to insure a positive pressure is also exerted on the driving portion of the hydraulic circuit. This will also enable reservoir assembly 86 to replenish any hydraulic fluid which may have been lost due to leakage from the driving portion of the circuit at least up to a maximum of the capacity of the reservoir assembly.

Additionally, it should be noted that as such a driving tool encounters a separation of the pintail portion of the set fastener, the sudden release of tension upon the pulling piston may result in a rearwardly directed pressure pulse and a sudden reduction of pressure in the forward or driving portion of the cylinder. This sudden pressure drop may, in severe cases, be sufficient to allow air to be drawn past the seals into the closed hydraulic system. In the present invention, the pressure relief valve may react to any such pressure impulse and will cooperate to maintain a positive minimum pressure on forward portion 70 of cylinder 68 thereby reducing the tendency for air entry into the hydraulic system.

In the event either one of the seals provided on pistons 48 or 74 become damaged or otherwise inoperative thereby permitting fluid communication between portions 24 and 26 of cylinder 20 or portions 70 and 72 of cylinder 68 respectively, the continued driving force generated by movement of piston 16 may result in high pressure build up within the hydraulic system. The reason for this build up of hydraulic pressure is that in the event of failure on the seal on piston 74 during a driving stroke, no further movement thereof will occur as the pressure differential across the piston will be decreased below that necessary to effect movement. However, piston 48 will continue to be driven by piston 16 and associated rod 52 with the result of reducing the volume of the hydraulic circuit, i.e. increasing pressure, due to the movement of rod 52 into cylinder 20. However, in the pull gun of the present invention this increased pressure will operate to open pressure relief valve 64 of FIG. 1 thereby venting the hydraulic fluid to atmosphere via bore 60 and reducing the possibility of blowing or otherwise damaging other seals in the installation tool. A similar result may occur should the seal on piston 48 fail thereby permitting fluid communication between portions 24 and 26 of cylinder 20 during a driving stroke.

A locking device may also be provided which may be utilized to lock plunger 104 in substantially any axial position relative to housing 94 so as to relieve the pressure within reservoir chamber 88. This can assist in avoiding loss of the fluid from the reservoir and hydraulic circuit through the hydraulic seals, during service. One form of such a locking device is shown in operative relationship to reservoir assembly 86 in FIG. 6 being indicated generally at 150 therein. Locking device 150 comprises an elongated threaded rod 152 having a head 154 provided on one end thereof, the opposite end 156 of which is adapted to be inserted through opening 126 in housing 94 and threadedly engage opening 124 provided in plunger 104. Head 154 may be provided with suitable serrations if desired to enable locking device 150 to be easily installed by hand. A jam nut 158 is threaded onto rod 152 and may be moved into engagement with surface 130 of housing 94 so as to thereby prevent further inward movement of plunger 104 into chamber 88. While normally it may be sufficient to merely lightly snug jam nut against surface 130 to prevent further movement of plunger 104, in some cases, it may be desirable to actually relieve the pressure created by biasing spring 102. This may be easily accomplished with locking device 150 by merely tightening jam nut 158 so as to move plunger 104 slightly rearwardly.

While the above description constitutes the preferred embodiment of the present invention, it will be appreciated that the invention is susceptible to modification, variation and change without departing from the proper scope or fair meaning of the accompanying claims.

I claim:

1. In a pneumatic-hydraulically actuated pull type installation tool adapted for use in setting of pull type fasteners comprising a tool housing having a pneumatically actuated piston means, a substantially closed hydraulic circuit containing a hydraulic fluid including a driving portion and a return portion and associated sealing means, control valve means for selectively actuating said pneumatic piston means, said pneumatic piston means being connected to and operative to drive a first hydraulic piston means whereby hydraulic fluid pressure is applied through said hydraulic circuit to a second piston means to thereby reciprocably alternately move said second piston means through a driving stroke and a return stroke, reservoir means having an outlet connected in fluid communication with at least one of said driving portions and return portions of said hydraulic circuit, check valve means connected to said outlet from said reservoir and operative to prevent fluid flow from said driving and return portions of said hydraulic circuits to said reservoir, said reservoir means comprises an elongated reservoir chamber within said housing, a reservoir housing member secured within an opening provided in said housing and having a bore extending therethrough, a plunger movably extending into said chamber and including a portion projecting into said bore, said chamber containing a supply of hydraulic fluid and including means for continuously exerting a pressure on said hydraulic fluid whereby said hydraulic fluid is operative to maintain a minimum positive pressure on said one of said portions of said hydraulic circuit during both said driving stroke and said return stroke to thereby improve the efficiency of said sealing means and reduce leakage of said hydraulic fluid through said sealing means and pressure relief valve means disposed in fluid communication with said one of said driving and return portions of said hydraulic circuit, said pressure relief means being operative to vent said one portion to atmosphere in response to abnormally high pressure therein.

2. An installation tool as set forth in claim 1 wherein said reservoir means further includes locking means associated with said reservoir means and operative to lock said plunger in position relative to said reservoir chamber whereby further movement of said plunger into said reservoir chamber is prevented.

3. An installation tool as set forth in claim 1 wherein said reservoir chamber includes an opening in one end of said chamber remote from said plunger, a removable plug member closing said opening and means for moving said plunger outwardly of said reservoir chamber a predetermined distance whereby said reservoir chamber may be refilled with hydraulic fluid through said opening.

4. An installation tool as set forth in claim 1 further comprising sight glass means provided in said reservoir housing member whereby the relative position of said plunger relative to said reservoir housing may be viewed so as to indicate the volume of hydraulic fluid remaining within said reservoir chamber.

5. An installation tool as set forth in claim 4 wherein said sight glass means comprises an elongated slot in a sidewall of said reservoir housing and a transparent member secured to said reservoir housing in overlying relationship to said slots.

6. An installation tool as set forth in claim 1 further comprising passage means extending between said driving portion and said return portion of said hydraulic circuit, and pressure relief valve means disposed within said passage means, said pressure relief valve means being operative to allow hydraulic fluid to flow from said one of said portions into the other of said portions in response to a predetermined pressure differential therebetween and to prevent fluid flow from said other portion to said one portion.

7. A pull type pneumatic hydraulic installation tool comprising:

a housing defining a pneumatic cylinder;

a pneumatically actuated piston means reciprocably disposed within said housing and dividing said cylinder into first and second portions;

control valve means for selectively applying compressed air alternatingly to said first and second portions;

a neck assembly having one end secured to said housing, said neck assembly including a master hydraulic cylinder having a master piston reciprocably disposed therein and dividing said master cylinder into a driving portion and a return portion;

means drivingly connecting said master piston to said pneumatically actuated piston;

a head assembly secured to the other end of said neck assembly and including a pulling cylinder having a hydraulically actuated pulling piston reciprocably disposed therein and operative to divide said pulling cylinder into a driving portion and a return portion;

driving passage means extending between said driving portion of said master cylinder and said driving portion of said pulling cylinder and operative to conduct pressurized fluid from said driving portion of said master cylinder to said driving portion of said pulling cylinder thereby enabling said master piston to drive said pulling piston through a driving stroke;

return passage means extending between said return portion of said master cylinder and said return portion of said pulling cylinder and operative to conduct pressurized fluid from said return portion of said master cylinder to said return portion of said pulling cylinder thereby enabling said master piston to drive said pulling piston through a return stroke;

reservoir means disposed within said head assembly, said reservoir means including a reservoir chamber having outlet passage means operative to place said chamber in fluid communication with said return portions of said master and pulling cylinders;

a plunger extending movably into said chamber;

biasing means engaging said plunger and being operative to continuously urge said plunger into said chamber whereby a pressure is exerted on a fluid within said chamber and said reservoir means is operative to maintain a continuous minimum positive fluid pressure on said return portions of said master and pulling cylinders;

check valve means disposed within said outlet passage means and operative to prevent fluid flow into said reservoir chamber;

first pressure relief valve means having an inlet connected in fluid communication with said return passage means and an outlet connected in fluid communication with said driving passage means, said return portion of said master cylinder having a fluid capacity slightly greater than the maximum fluid capacity of said return portion of said pulling cylinder whereby movement of said master piston toward said one end is operative to produce a pressure differential between said return passage means and driving passage means sufficient to open said first pressure relief valve means to enable transfer of fluid to said driving passage means, said pressure relief valve being operative to maintain a minium positive fluid pressure on said driving portions of said master and pulling cylinders; and a second pressure relief valve having an inlet in fluid communication with said return passage means and being operative to vent said return passage means to atmosphere in response to abnormal pressure within said return passage means.

8. In a pull type installation tool having a substantially closed hydraulic operating circuit including a master cylinder containing a supply of hydraulic fluid and having a master piston reciprocably disposed therein, means for selectively moving said master piston between opposite ends of said master cylinder, a pulling cylinder having a pulling piston reciprocably disposed therein and first passage means for placing a first end portion of said master cylinder in fluid communication with a first end portion of said pulling cylinder and second passage means for placing a second end portion of said master cylinder in fluid communication with a second end portion of said pulling cylinder whereby movement of said master piston toward one of said first and second ends of said master cylinder will be operative to cause hydraulic fluid to flow under pressure from said one of said first and second ends of said master cylinder to a corresponding one of said first and second ends of said pulling cylinder thereby moving said pulling piston and also causing fluid flow from the other of said first and second ends of said pulling cylinder to the other of said first and second ends of said master cylinder whereby reciprocable movement of said master piston will effect a corresponding reciprocable movement of said pulling piston, pressure relief valve means operatively connected to enable fluid communication from said first to said second passage means in response to a predetermined pressure differential between said first and second passage means, reservoir means containing a supply of hydraulic fluid, reservoir passage means connecting said reservoir with said first passage means and check valve means disposed within said reservoir passage means and operative to prevent return of hydraulic fluid to said reservoir, said first end portion of said master cylinder having a fluid capacity slightly greater than the maximum fluid capacity of said one end of said pulling cylinder whereby movement of said master piston toward said one end is operative to produce a pressure differential at least equal to said predetermined pressure differential so as to open said pressure relief valve thereby enabling fluid to flow from said first passage means to said second passage means, said reservoir being operative to replenish fluid flowing from said first passage means to said second passage means.

9. An installation tool as set forth in claim 8 wherein said reservoir means is continuously pressurized whereby said reservoir means is operative to maintain a minimum positive pressure within said one ends of said master cylinder and said pulling cylinder.

10. An installation tool as set forth in claim 9 wherein said reservoir means includes an elongated chamber containing said fluid supply, an elongated plunger having one end extending into said chamber, and biasing means for urging said plunger into said chamber so as to exert a pressure on said fluid supply.

11. An installation tool as set forth in claim 10 wherein said biasing means includes a reservoir housing surrounding the other end of said plunger and spring means extending between said housing and said plunger.

12. An installation tool as set forth in claim 10 further including check valve means disposed in fluid communication with and between said reservoir and said first passage means and operative to allow fluid flow from said reservoir to said first passage means and to prevent fluid flow from said first passage means to said reservoir.

13. An installation tool as set forth in claim 8 further comprising second pressure relief valve means disposed in fluid communication with said first passage means, said pressure relief valve means being operative to vent said first passage means to atmosphere in response to an abnormally high pressure therein.

* * * * *

UNITED STATES PATENT AND TRADEMARK OFFICE

CERTIFICATE OF CORRECTION

PATENT NO. : 4,597,263

DATED : July 1, 1986

INVENTOR(S) : Robert J. Corbett

It is certified that error appears in the above-identified patent and that said Letters Patent is hereby corrected as shown below:

Column 1, line 24, after "reciprocably" insert --disposed--.
Column 2, line 53, delete "22" and substitute therefor --12--.
Column 3, line 3, delete "value" and substitute therefor --valve--.
Column 3, line 5, delete "level" and substitute therefor --lever--.
Column 6, line 9, delete "portions" and substitute therefor --portion--.
Column 6, line 37, after "is" insert --a--.
Column 6, line 38, delete "termind" and substitute therefor --termined--.
Column 8, line 52, Claim 5, delete "slots" and substitute therefor --slot--.
Column 9, line 59, Claim 7, delete "minium" and substitute therefor --minimum--.

Signed and Sealed this

Twenty-fourth Day of February, 1987

*Attest:*

DONALD J. QUIGG

*Attesting Officer* *Commissioner of Patents and Trademarks*